United States Patent [19]

Hidaka

[11] Patent Number: 4,488,829

[45] Date of Patent: Dec. 18, 1984

[54] MULTIBIN SHEET FEEDER FOR USE WITH A PRINTER

[76] Inventor: Kenjiro Hidaka, 2040 Pelham Ave., Los Angeles, Calif. 90025

[21] Appl. No.: 384,333

[22] Filed: Jun. 2, 1982

[51] Int. Cl.[3] ..... B41J 11/58

[52] U.S. Cl. ..... 400/605; 400/629; 271/9

[58] Field of Search ..... 400/605, 613.2, 617, 400/607, 608.4, 624, 629, 636, 634, 625, 627, 578, 603, 636.1, 636.2; 312/208; 271/9, 126, 127, 160; 355/35 H, 145 H

[56] References Cited

U.S. PATENT DOCUMENTS

| | | | |
|---|---|---|---|
| 3,070,204 | 12/1962 | Bradshaw | 400/605 X |
| 3,947,015 | 3/1976 | Funk et al. | 271/9 |
| 4,343,461 | 8/1982 | Tomimori et al. | 271/160 X |

*Primary Examiner*—Edgar S. Burr
*Assistant Examiner*—Charles A. Pearson
*Attorney, Agent, or Firm*—W. Edward Johansen

[57] ABSTRACT

The present invention is a sheet feeder for use in combination with a printer. The sheet feeder includes a frame which is substantially symmetrical about a bisecting vertical plane and which has a sheet outlet. The top of the frame is in a first horizontal plane and the printer, which has a sheet inlet, is disposed thereon. The sheet outlet is adjacent and contiguous to the top of the frame and can be aligned with the sheet inlet of the printer. The sheet feeder also includes a first tray and a second tray which are movably coupled to the frame and which are disposed opposingly to each other and parallel to a first plane and a second plane, respectively, which are slanted with respect to the first horizontal plane. A first stack of sheets, face up, and a second stack of sheets, face down, can be disposed on the first and second trays, respectively. The sheet feeder further includes first and second feed rollers, first and second supporting mechanisms for supporting the first and second trays, respectively, and first and second resiliently biasing mechanisms for resiliently biasing the first and second trays, respectively, whereby the first and second trays urge the first and second stacks of sheets, respectively against the first and second feed rollers, respectively.

9 Claims, 6 Drawing Figures

MULTIBIN SHEET FEEDER FOR USE WITH A PRINTER

BACKGROUND OF THE INVENTION

1. Field of the Invention

The present invention relates to a sheet feeder for attachment to a printer which is placed on top of the sheet feeder and more particularly to a sheet feeder which includes multiple bins or cassettes in which stacks of sheets are disposed and a pair of which contain movable trays which are slantly disposed and resiliently coupled to the frame of the sheet feeder in order to hold and selectively feed a variety of sizes of sheets to the printer.

2.Description of the Prior Art

Sheet feeders are used to handle a wide variety of materials such as cut sheets, preprinted forms, envelopes, and continuous computer sheets. As office systems are now more and more automated and computerized, an increasing number of sheet feeders have been recently made available. A majority of the sheet feeders has so far been used for copying machines. A comparatively smaller number of sheet feeders for printer application has been made available. Printers are sometimes called electronic typewriters and are producing a growing percentage of office written output. The sheet feeders for these printers should be efficient and convenient to use.

The sheet feeder which U.S. Pat. No. 4,248,415 teaches is typical of most of the presently available cut sheet feeders which are placed on top of the printers and electronic typewriters. These printer-top sheet feeders hold a comparatively small capacity of sheets and have coherent problems of sheet separation. In other words, with printer-top sheet feeders one or more sheets tend to be carried along by inter-sheet frictional forces with the one sheet which alone should be fed because the feed direction is generally downward thereby the force of gravity tends to help extra sheets to be dragged down. Printer-top sheet feeders have a disadvantage of blocking the printed sheet paths leading to sheet stackers which may be disposed behind the printers. Therefore, a printer-top sheet feeder normally has a small capacity printed sheet collector in the front section of the sheet feeder. Most office printers accept both cut sheets and continuous sheets. However, automatic cut sheet feeders for printers do not normally possess a provision for holding and feeding a continuous sheet. A conventional cut sheet feeder must often be removed when a continuous sheet is fed in place of cut sheets.

U.S. Pat. No. 4,248,415, entitled Apparatus for Feeding Sheets of Paper from a Magazine to a Printing Office Machine, issued to Helmut Steinhilber on Feb. 3, 1981, teaches an apparatus for feeding single sheets of paper to a printing office machine, for example a typewriter or a bookkeeping machine. The paper is held in a stack within one or more magazine and the top sheet of the stack is engaged by a separating roller which is driven by a gear belt from the printing platen or another rotating part of the associated office machine. In order to insure the exact positioning at the entrance of the printing platen slot of the sheets of paper delivered by the separating roller, the apparatus provides that when the separating roller transports a sheet of paper forward to the printing platen the printing platen is rotating backward at that time thereby preventing entry of the new sheet while insuring the position as the continued motion of the separating roller causes the new sheet to bulge. Thereafter, the direction of rotation of the printing platen is reversed causing the reliable advance of the paper into the printing office machine. During this time, an overrunning clutch prevents reverse motion of the separating roller. In order to provide for limited reversal of motion of the printing platen during the printing process, a lost motion mechanism in the drive of the separating roller permits limited paper reversal.

U.S. Pat. No. 4,232,860, entitled Paper Feeder, issued to Frank H. Brown on Nov. 11, 1980, teaches a top-load, bottom-feed friction feeder which includes a power source having connected thereto a main feed wheel and an eccentric wheel. A stone wheel is located adjacent to the main feed wheel and can be adjusted so that the feeder can continuously feed pieces which have a wide variety of sizes, stocks and orientation.

U.S. Pat. No. 4,240,622, entitled Mechanism for Transporting Sheetlike Recording Carriers, issued to Albert Rutishauser on Dec. 23, 1980, teaches a sheet transporting magazine for automatic typewriters or the like with a three point bar structure for arching a stack of sheets in the conveyance direction while disposed in the magazine to prevent the sheets from canting laterally in the magazine.

U.S. Pat. No. 4,310,151, entitled Sheet Feeding Apparatus, issued to Sakae Fujimoto on Jan. 12, 1982, teaches a sheet feeding apparatus which includes a vertically movable vacuum plate which has opening for sucking sheets individually and which allows sheet feeding rollers to extend therethrough for translating the sucked sheet wherein a sheet pressing portion is formed in the vacuum plate to form a space between the forward end portions of the sheets and the vacuum plate prior to the suction of the sheets. In another embodiment, instead of the sheet pressing portion, a sheet feeding roller which is mounted on the vacuum plate is utilized as the sheet pressing element so that the sheets are pressed before being sucked causing the suction force to be applied to the forward end portions of the sheets.

U.S. Pat. No. 4,312,503, entitled Spring-Loaded Friction Retard Separator, issued to Allan L. Saxinger, Clayton M. Haight and Barry C. Kockler on Jan. 26, 1982, teaches a sheet feeding and separating apparatus for separating a single sheet from a stack of sheets and forwarding the separate sheet away for subsequent processing. The apparatus includes a feed belt which is disposed adjacent to the stack for contacting the top sheet in order to separate the top sheet from the stack. A retard shoe is resiliently biased into engagement with the feed belt. Actuation of the feed belt and engagement of the retard shoe with the sheets provide a rotating and locking relation with the mounting member of the retard shoe thereby preventing passage of multiple sheets by the feed belt but allowing the fed sheet to be pulled from the apparatus by a low amount of pulling force.

U.S. Pat. No. 4,211,398, entitled Feeders for Cardboard and Like Blanks, issued to Thomas D. Bishop on July 8, 1980, teaches a feed having two stack which are top feed by reciprocating suction boxes. The stacks feed alternately and a belt is used to transfer blanks from the rear stack.

U.S. Pat. No. 4,310,152, entitled Stacker for Film Material, issued to Wilhelm Mitzel on Jan. 12, 1982, teaches a stack for sheet material which has a stacker drum. The stacker drum receives sheet from a transport system at a first tangential position and arcuately moves them to a stop at a second tangential position against which the stack is formed. The stacker drum has a row of suction openings for gripping the leading edge of the sheets followed by compressed air openings which are positioned behind the suction openings sufficiently far so that the compressed air is applied to the sheets only after the leading edges have been run up against the stop.

U.S. Pat. No. 4,236,709, entitled Cartridge Sheet Feed Attachment, issued to Ronald E. Hunt on Dec. 2, 1980, teaches a compact sheet feeding apparatus which is suitable for attachment to a printer and which includes a removable cartridge for holding a stack of sheets. The cartridge provides an integral edge aligner surface and second sheet restraint during lateral shingling of sheets prior to feeding in a direction transverse to shingling.

U.S. Pat No. 4,245,831, entitled Adjustable Tray, issued to Stephen F. Michatek on Jan. 20, 1980, teaches a tray which receives and guides document sheets that are being manually fed to a copier/dupicator or printer. The tray has a plurality of flexible segments which are movable in pairs for adjusting the size of the guide surface so that sheets of several sizes can be accommodated by the tray.

U.S. Pat. No. 4,221,375, entitled Copy Sheet Handling Apparatus for a Copier, issued to Douglas I. Morrison and William Gergely, Jr. on Sept. 9, 1980, teaches a copy sheet handling apparatus which includes a pair of feed rollers spaced apart from each other, and a copy sheet tray which extends substantially transversely through a plane which, in turns, extends midway between the feed rollers. The copy sheet handling apparatus also includes a structure for swivelably supporting the tray in the aforesaid plane and mechanisms, which are coupled to the structure, for applying a resilient force to the tray substantially in the aforesaid plane in order to move the tray toward the feed rollers for disposition of a copy sheet into engagement with the feed rollers whereby the force is substantially equally distributed between the feed rollers.

Today's office printers are most often used for typing letters. There are kinds of letter sheets, normally one with a letter head for the first page and another for succeeding pages. Therefore an almost mandatory requirement for an efficient automatic sheet feeder for office printers is a capability of feeding cut sheets from either of two stacks of sheets selectively one at a time. It should be a preferrable feature that a sheet feeder accommodates a variety of sizes of sheets without its mechanism being too complicated.

In many instances printers are disposed on dedicated stands which have empty spaces within their frames. Such empty spaces should be ultilized if possible.

An advantage of a sheet feeder which is disposed under the printer wherein the sheets are fed through the bottom of the printer is that a printer-top sheet feeder may also be utilitized simultaneously in addition to the underprinter sheet feeder when an additional type of sheets, such as envelopes and cut sheets of additional kinds, are required.

SUMMARY OF THE INVENTION

In view of the foregoing factors and conditions which are characteristic of the prior art it is the primary object of the present invention to provide a simple and low cost sheet feeder which will hold two stacks of cut sheets, each of the two stacks may be of a different size of sheets from the other, and which will automatically and selectively feed the sheets to a printer one at a time.

It is another object of the present invention to provide a sheet feeder for a printer wherein top sheet separation from a stack of sheets is easily made thereby minimizing double feeding and sheet jamming problems.

It is still another object of the present invention to provide a sheet feeder which can accomodate a continuous sheet in addition to stacks of cut sheets for feeding to a printer.

It is yet another object of the present invention to provide a sheet feeder for a printer wherein the frame of the sheet feeder serves as a stand for the printer.

It is further object of the present invention to provide a sheet feeder for a printer wherein sheets are easily and reliably fed to a printer.

It is still further object of the present invention to provide a sheet feeder for a printer which is disposed under a printer and feeds sheets to the printer through its bottom whereby the sheet feeder does not occupy a space on top of the printer thereby providing the printer with a clear pathway for printed-sheets and ample room for stacking a large quantity of the printed-sheets.

It is yet further object of the present invention to provide sheet feeders for printers both of heavy duty use and of light duty use which are more convenient for office personnel to use.

In accordance with the present invention an embodiment of a sheet feeder for use in combination with a printer is described. The sheet feeder includes a frame which is substantially symmetrical about a bisecting vertical plane and which has a sheet outlet. The top of the frame is in a first horizontal plane and the printer, which has a sheet inlet, is disposed thereon. The sheet outlet is adjacent and contiguous to the top of the frame and can be aligned with the sheet inlet of the printer. The sheet feeder also includes a first tray and a second tray which are movably coupled to the frame and which are disposed opposingly to each other and parallel to a first plane and a second plane, respectively, which are slanted with respect to the first horizontal plane. A first stack of sheets, face up, and a second stack of sheets, face down, can be disposed on the first and second trays, respectively. The first and second trays have a first leading edge and a second leading edge, respectively, adjacent, but not contiguous, to the vertical bisecting plane. When the first leading edge and the second leading edge are disposed in the same plane, which is parallel to the first horizontal plane and orthogonal to the bisecting vertical plane, the first and second trays form a generally inverted V-shape. The sheet feeder further includes first and second feed rollers, first and second supporting mechanisms for supporting the first and second trays, respectively, and first and second resiliently biasing mechanisms for resiliently biasing the first and second trays, respectively, whereby the first and second trays urge the first and second stacks of sheets, respectively, against the first and second feed rollers, respectively. The first and second feed rollers separate a first top sheet and a second top sheet, respectively, from the first and second stacks of sheets, respectively, one at a time, and feed the first top sheet and the second top sheet, respectively, toward the printer. The sheet feeder may accommodate a continuous sheet under the first and second trays and provides a passway therebetween so that the continuous sheet may be directed upwardly through the passway and fed to the printer.

The features of the present invention which are believed to be novel are set forth with particularity in the appended claims.

Other objects and many of the attendant advantages will be more readily appreciated as the same becomes better understood by reference to the following detailed decription and considered in connection with the accompanying drawing in which like reference symbols designate like parts throughout the figures.

DESCRIPTION OF THE PREFERRED EMBODIMENT

Figure 1:
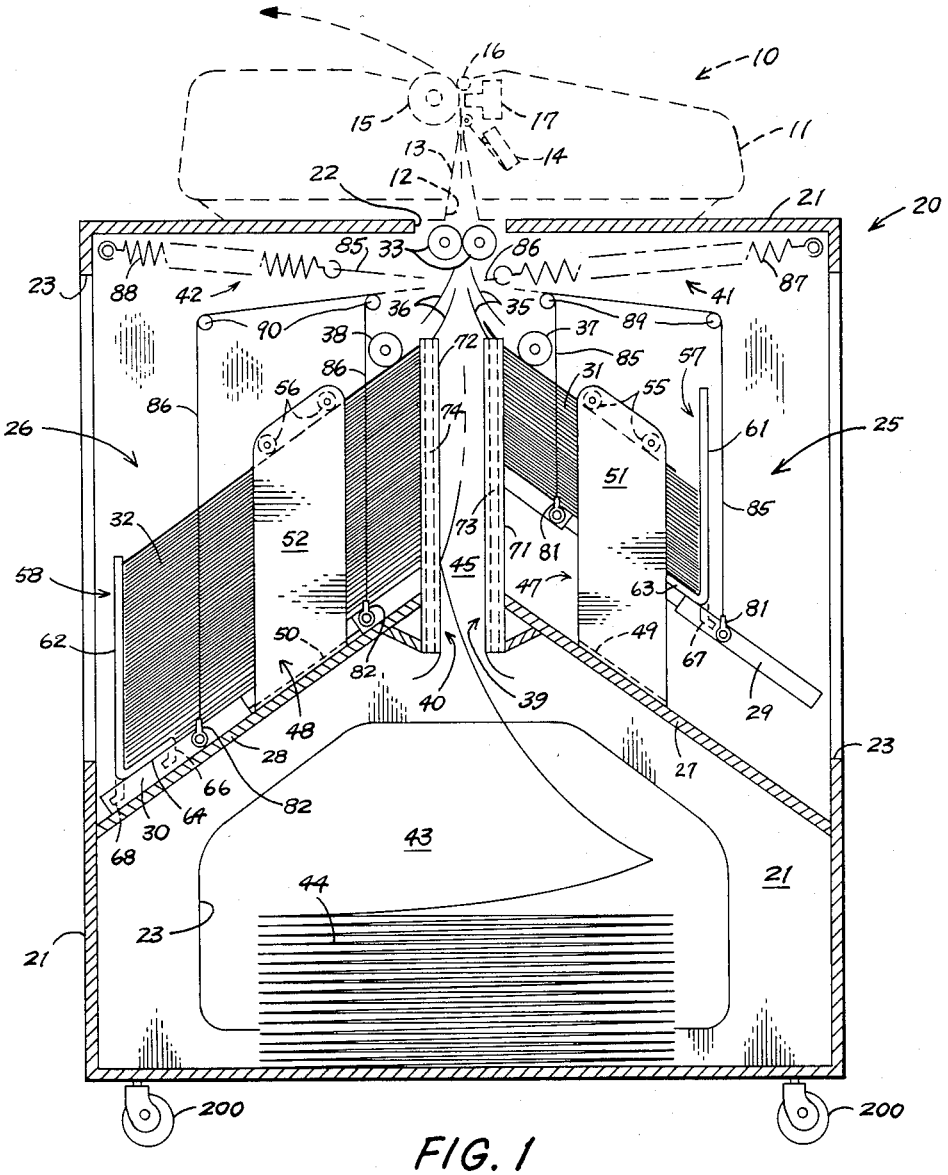
FIG. 1 is a side elevational view in cross-section of the first embodiment of the sheet feeder for a printer which is constructed in accordance with principles of the present invention.

In order to best understand the present invention it is necessary to refer to the following description of its preferred embodiment in conjunction with the accompanying drawings. Referring to FIG. 1 a printer 10 includes a frame 11 with a sheet inlet 12, a printer sheet guide 13 fixedly coupled to the frame 11 adjacent to the sheet inlet 12 and a sheet sensor 14 disposed within the frame 11 adjacent to the printer sheet guide 13. The printer 10 also includes a platen 15 which is rotatably coupled to the frame 11, a pinch roller 16 which is rotatably coupled to the frame 11 adjacent and contiguous to the platen 15 and a print head 17. The printer 10 is a conventional prior art in the industry and is not the object of the invention. The printer 10 may be used in combination with a sheet feeder 20 which includes a frame 21 which is substantially symmetrical about a bisecting vertical plane and which has a sheet outlet 22 and access windows 23. The top of the frame 21 is in a first horizontal plane and the printer 10 is disposed thereon. The sheet outlet 22 is adjacent and contiguous to the top of the frame 21 and can be aligned with the sheet inlet 12 of the printer 10. The frame 21 is divided into a first portion of the frame 21 and a second portion of the frame 21, which are substantially identical to each other, by the bisecting vertical plane. The frame 21 provides a first bin 25 and a second bin 26 which are in the first and second portions of the frame 21, respectively, and which have a first base plate 27 and a second base plate 28, respectively. The sheet feeder 20 also includes a first tray 29 and a second tray 30 which are disposed in the first and second bins 25 and 26, respectively, and which are movably coupled to the frame 21. The first and second trays 29 and 30 are disposed opposingly to each other and parallel to a first plane and a second plane, respectively, which are slanted with respect to the first horizontal plane. A first stack 31 of sheets, face up, and a second stack 32 of sheets, face down, can be disposed on the first and second trays 29 and 30, respectively. The sheet feeder 20 further includes a first sheet feeding mechanism and a second sheet feeding mechanism which are coupled to the frame 21 and which separate a first top sheet and a second top sheet, respectively, from the first and second stacks 31 and 32 of sheets, respectively, in order to feed the first top sheet and the second top sheet, respectively, toward the printer 10. The initial moving directions of the first top sheet and the second top sheet, respectively, define a first sheet moving direction and a second sheet moving direction, respectively.

Still referring to FIG. 1 the sheet feeder 20 further includes a pair of guide rollers 33 rotatably coupled to the frame 21, a first set of sheet guides 35 and a second set of sheet guides 36 fixedly coupled to the frame 21, and a first feed roller 37 and a second feed roller 38 rotatably coupled to the frame 21 for separating the top sheet from the first and second stacks 31 and 32, respectively, of sheets one at a time and feeding the top sheet toward the printer 10 through the first set of sheet guides 35 and the second set of sheet guides 36, respectively, and the pair of guide rollers 33. The sheet feeder 20 still further includes a first supporting mechanism 39 and a second supporting mechanism 40 for supporting the first and second trays 29 and 30, respectively, and a first resiliently biasing mechanism 42 and a second resiliently biasing mechanism 41 for resiliently biasing the first and second trays 29 and 30, respectively, whereby the first and second trays 29 and 30 urge the first and second stacks 31 and 32 of sheets against the first and second feed rollers 37 and 38, respectively. The frame 21 of the sheet feeder 20 also provides a third bin 43 which is disposed generally under the first and second bins 25 and 26 for accommodating the continuous sheet 44 wherein the first and second bins 25 and 26 provide a passway 45 therebetween so that the continuous sheet 44 may be directed upwardly through the passway 45, between the first and second sets of sheet guides 35 and 36, through the pair of guide rollers 33 and through the sheet outlet 22, and fed to the printer 10. The leading edge of the continuous sheet 44 is manually introduced to the pair of guide rollers 33 initially so that the pair of guide rollers 33 may thereafter take up and feed the continuous sheet 44 to the printer 10. No sheet of the first and second stacks 31 and 32 of sheets may be fed while the continuous sheet 44 is being fed. Sheets of the first and second stacks 31 and 32 of sheets may be fed only when the pair of guide rollers 33 are free of the continuous sheet 44. The sheet feeder 20 includes a first pair of vertical side plates 47 and a second pair of vertical side plates 48 which position the first and second stacks 31 and 32 of sheets, respectively, therebetween and which are adjustably coupled to the first and second base plates 27 and 28, respectively, of the first and second bins 25 and 26, respectively.

Figure 2:
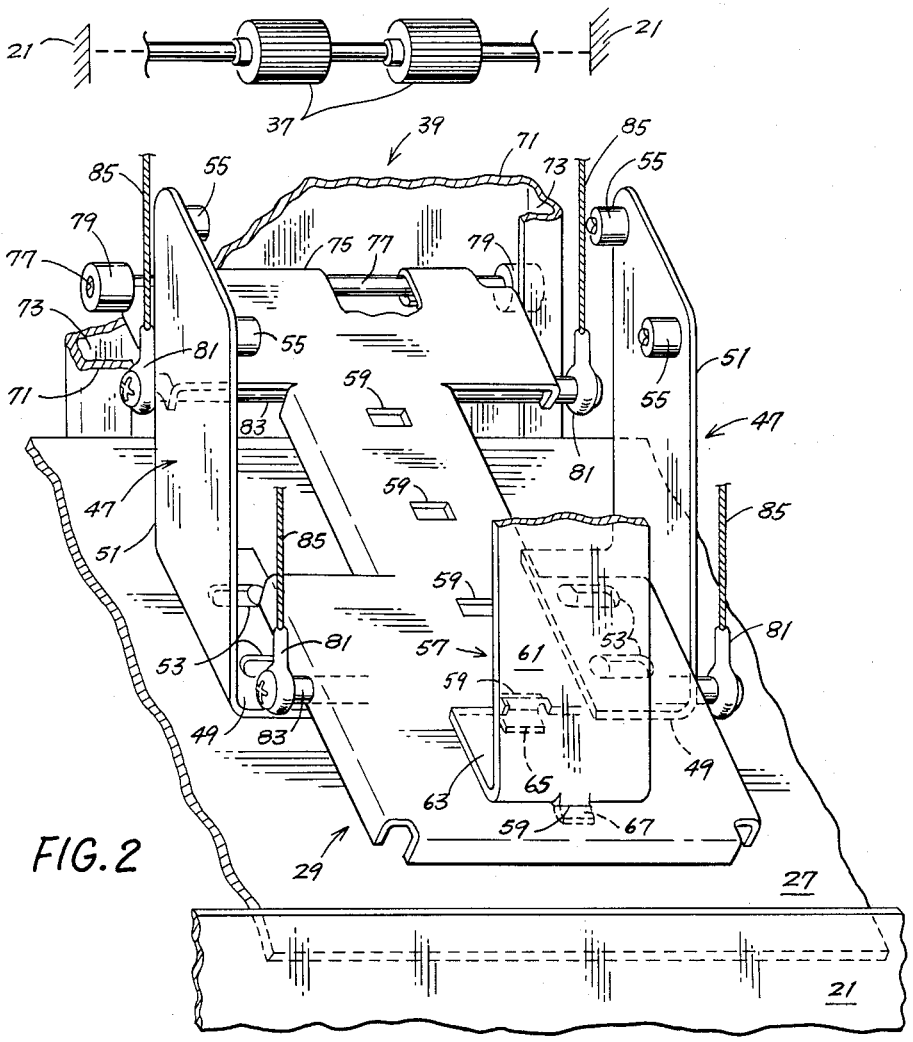
FIG. 2 is a perspective view of a part of the mechanism of the sheet feeder of FIG. 1 in partial cross-section.

A first part of the mechanism which is disposed in the first bin 25 of the sheet feeder 20 is depicted in detail in FIG. 2. There is a corresponding second part of the mechanism, (not shown), which is disposed in the second bin 26 of the sheet feeder 20 and which is identical to the first part of the mechanism in the first bin 25. Both the first and second parts and the first and second bins 25 and 26 are symmetrically disposed about a vertical plane passing between the pair of guide rollers 33.

Referring now to FIG. 2 in conjunction with FIG. 1 the first and second pairs of vertical side plates 47 and 48 position the first and second stacks 31 and 32 of sheets, respectively, therebetween. The first and second pairs of vertical side plates 47 and 48 are frictionally and slidably adjustable horizontally and orthogonally to the first and second sheet moving directions, respectively. Each of the first and second pairs of vertical side plates 47 and 48 has a first base section 49 and a second base section 50, respectively, and a first sidewall 51 and a second sidewall 52, respectively. Each of the first base sections 49 of the first pair of vertical side plates 47 has a first pair of parallel elongated slots 53. Each of the second base sections 50 of the second pair of vertical side plates 48 has a second pair of parallel elongated slots, (not shown). The first and second base sections 49 and 50 are adjustably and slidably coupled to the first and second base plates 27 and 28, respectively, of the first and second bins 25 and 26, respectively. The first sidewall 51 of each of the first pair of vertical side plates 47 has a first pair of idler rollers 55 disposed contiguous to its top edge for holding thereunder the first stack 31 of sheets. The second sidewall 52 of each of the second pair of vertical side plates 48 has a second pair of idler rollers 56 disposed contiguous to its top edges for holding thereunder the second stack 32 of sheets. The vertical position of the first and second pairs of idler rollers 55 and 56 are suitably determined so that the first and second stacks 31 and 32 of sheets, respectively, are not too tightly urged thereagainst. The sheet feeder 20 also includes a first sheet holding plate 57 and a second sheet holding plate 58 which are removably and fixedly coupled to the first and second trays 29 and 30, respectively.

Figure 3:
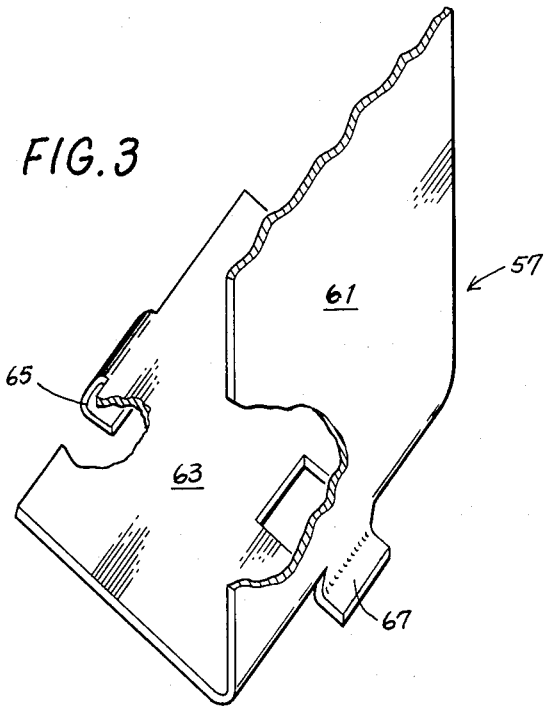
FIG. 3 is a perspective view section of an incrementally adjustable sheet holding plate of the movable tray of FIG. 2 and FIG. 3 in partial cross-section.

The first sheet holding plate 57 is depicted in detail in FIG. 3. The second sheet holding plate 58, depicted in FIG. 1, is identical to the first sheet holding plate 57.

Referring now to FIG. 2 in conjunction with FIG. 1 and FIG. 3 first slots in a row 59 and second slots in a row are provided in the transversely middle sections of the first and second trays 29 and 30, respectively. The first and second sheet holding plates 57 and 58 include a first sheet backing section 61 and a second sheet backing section 62, respectively, and a first foot section 63 and a second foot section 64, respectively. The first and second foot section 63 and 64 have a first front flange 65 and a second front flange 66, respectively, and a first rear flange 67 and a second rear flange 68, respectively, which are mechanically engaged with a pair of slots of the first and second slots in a row 59 of the first and second trays 29 and 30, respectively. The positions of the first and second sheet holding plates 57 and 58 are incrementally adjustable in the directions which are parallel to the first and second sheet moving directions, respectively, and which uphold the first and second stacks 31 and 32, of sheets respectively, on their trailing edge-sides thereby preventing the first and second stacks 31 and 32 of sheets, respectively from slipping down.

Referring again to FIG. 2 in conjunction with FIG. 1 the first and second supporting mechanisms 39 and 40 include a first rail 71 and a second rail 72, respectively, which have a first pair of slots 73 and a second pair of slots 74, respectively. The first and second trays 29 and 30 have a first leading edge 75 and a second leading edge (not shown), respectively, and are fixedly coupled to a first axial rod (not shown) 77 and a second axial rod, respectively. A first pair of spacers 79 and a second pair of spacers (not shown) are fixedly coupled to the first axial rod 77 and the second axial rod, respectively, at each of their ends. The first pair of spacers 79 and the second pair of spacers are slidably coupled to the first and second pair of slots 73 and 74 of the first and second rails 71 and 72, respectively. The diameters of the first pair of spacers 79 and the second pair of spacers are large enough so that the first leading edge 75 and the second leading edge of the first and second trays 29 and 30, respectively, do not touch the first and second supporting mechanisms 39 and 40, respectively. The first leading edge 75 and the second leading edge are adjacent, but not contiguous, to the vertical bisecting plane. When the first leading edge 75 and the second leading edge are disposed in the same plane, which is parallel to the first horizontal plane and orthogonal to the bisecting vertical plane, the first and second trays 29 and 30 form a generally inverted V-shape.

Referring still to FIG. 2 in conjunction with FIG. 1 the first and second supporting mechanisms 39 and 40 also include a first set of four sockets 81 and a second set of four sockets 82, respectively, and a first pair of elongated rods 83 and a second pair of elongated rods to which the first and second sets of sockets 81 and 82 are fixedly coupled to their ends thereof, respectively, and which are transversely fixedly coupled to the first and second trays 29 and 30, respectively. The first and second supporting mechanisms 39 and 40 further include a first set of four cables 85 each of which is fixedly coupled to one of the first set of four sockets 81 and a second set of four cables 86 each of which is fixedly coupled to one of the second set of four sockets 82. The first and second sets of four cables 85 and 86 are resiliently coupled to the frame 21 by a first pair of springs 88 and a second pair of springs 87, respectively, and a first set of four pulleys 89 and a second set of four pulleys 90, respectively, which are rotatably coupled to the frame 21. The first pair of springs 88 and the first set of four pulleys 89 are disposed so that each of the first pair of springs 88 takes the load of the two cables of the first set of four cables 85 on the same side of the first tray 29. The second pair of springs 87 and the second set of four pulleys 90 are disposed so that each of the second pair of springs 87 takes the load of the two cables of the second set of four cables 86 on the same side of the second tray 30. Thus the first and second trays 29 and 30 are suspended with sufficient stability against the shift of the center of gravity of the first and second stacks 31 and 32 of sheets, respectively, in the first and second sheet moving directions, respectively, which will occur when sheets of different lengths are loaded onto the first and second trays 29 and 30.

Figure 4:
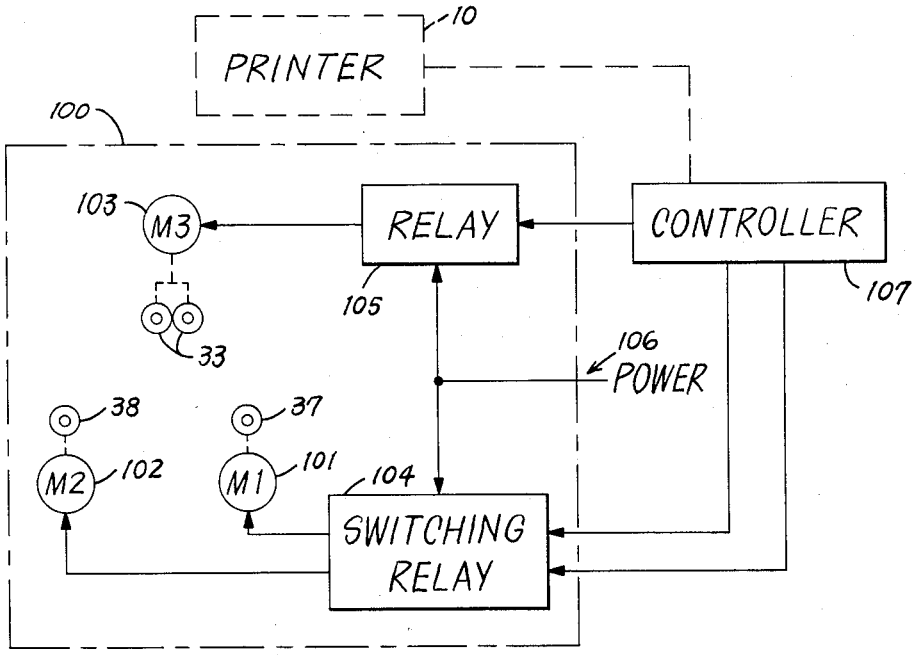
FIG. 4 is a schematic drawing of the control circuit for the sheet feeder and the printer of FIG. 1.

Referring to FIG. 4 the sheet feeder 20 includes a driving apparatus 100 consisting of a first motor 101, a second motor 102, a third motor 103, a switching relay 104, a relay 105, and a power inlet 106, all of which are fixedly coupled to the frame 21. The first motor 101 is for driving the first feed roller 37 and the second motor 102 is for driving the second feed roller 38. The third motor 103 is for driving the pair of guide rollers 33. A controller 107, which is not part of the sheet feeder 20, may be electrically connected to the switching relay 104 and the relay 105 of the sheet feeder 20 and also to the printer 10. The power inlet 106 may be connected to an electrical power source. The controller 107 controls the switching relay 104 so that the electrical power selectively energizes either the first motor 101 or the second motor 102 at an appropriate timing for an appropriate period of time, one at a time, resulting in the selective actuation of either the first feed roller 37 or the second feed roller 38, in turn causing either the first top sheet or the second top sheet of the first stack 31 of sheets and the second stack 32 of sheets, respectively, to be separated and fed one at a time. The controller 107 also controls the relay 105 so that the electrical power energizes the third motor 103 at an appropriate timing for an appropriate period of time resulting in the actuation of the pair of guide rollers 33 in turn causing either the first top sheet or the second top sheet already separated from the first stack 31 of sheets and the second stack 32 of sheets, respectively, to be further advanced and fed to the printer 10.

Referring to FIG. 4 in conjuction with FIG. 1 on the other hand, the sheet sensor 14 of the printer 10 senses the passage of the leading edge and the trailing edge of the sheet fed to the printer 10 and sends electrical signals to the controller 107 so that the controller 107 performs computations in reference to the electrical signals and sends out the appropriate signals to the switching relay 104 and/or the relay 105 for energization of the first motor 101, the second motor 102 and the third motor 103 at appropriate timing and for an appropriate period of time. In the case where the continuous sheet 40 is being fed to the printer 10 only the third motor 103 for driving the pair of guide rollers 33 is energized at an appropriate timing for an appropriate period of time. All of the above electrical control systems are conventional.

Figure 5:
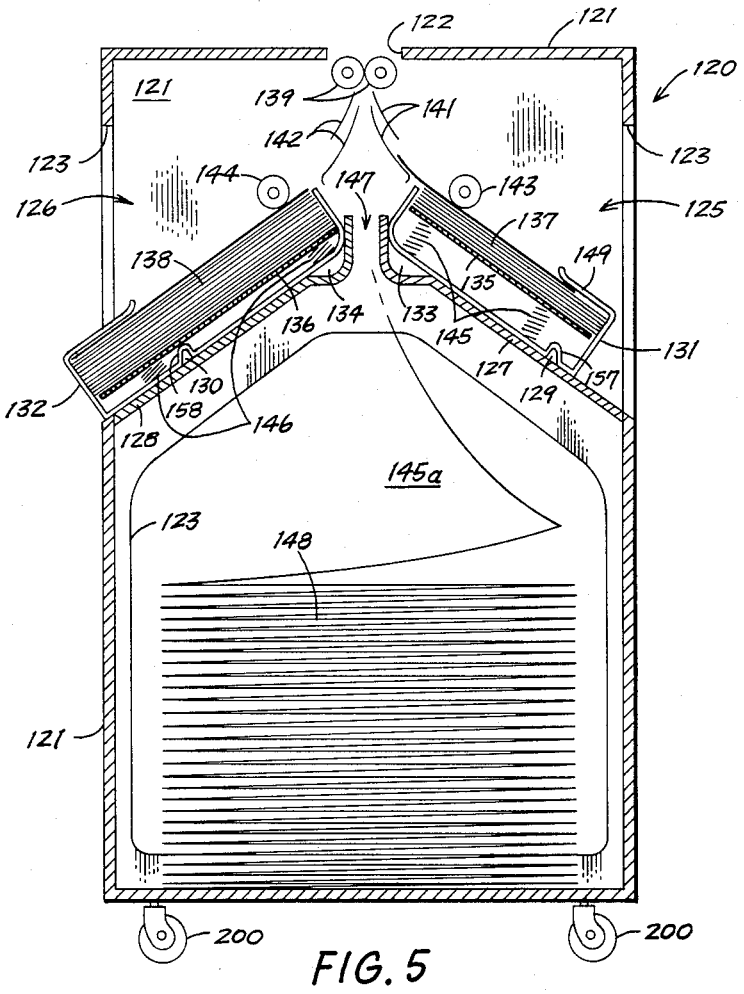
FIG. 5 is a side elevational view in cross-section of the second embodiment of the sheet feeder for a printer which is also constructed in accordance with principles of the present invention.

Referring to FIG. 5 a printer (not shown), which has a sheet inlet (not shown), may be used in combination with a second embodiment of the present invention. The sheet feeder 120 which includes a frame 121 which is substantially symmetrical about a bisecting vertical piane and which has a sheet outlet 122 and access windows 123. The top of the frame 121 is in a first horizontal piane and the printer is disposed thereon. The sheet outlet 122 is adjacent and contiguous to the top of the frame 121 and can be aligned with the sheet inlet of the printer. The frame 121 is divided into a first portion of the frame 121 and a second portion of the frame 121, which are substantially identical to each other, by the bisecting vertical plane. The frame 121 provides a first bin 125 and a second bin 126 which are in the first and second portions of the frame 121, respectively, and which have a first base plate 127 and a second base plate 128, respectively. The first and second base plates 127 and 128 have a first pair of projections 129 and a second pair of projections 130, respectively. The sheet feeder 120 also includes a first cassette 131 and a second cassette 132 which are disposed opposingly to each other and parallel to a first plane and a second plane, respectively, which are slanted with respect to the first horizontal plane. The first and second cassettes 131 and 132 are securely, but removably coupled to the first and second base plates 127 and 128, respectively, wherein the first cassette 131 and the second cassette 132 form a generally inverted V-shape. The first and second base plates 127 and 128 provide a first escape 133 and a second escape 134, respectively, for easy insertion of the first and second cassettes 131 and 132, respectively. The sheet feeder 120 further includes a first tray 135 and a second tray 136 which are disposed within and resiliently movably coupled to the first cassette 131 and the second cassette 132, respectively. The first and second trays 135 and 136 hold a first stack 137 of sheets, face-up, and a second stack 138 of sheets, face-down, respectively.

Still referring to FIG. 5 the sheet feeder 120 still further includes a pair of guide rollers 139 rotatably coupled to the frame 121, a first set of sheet guides 141 and a second set of sheet guides 142 fixedly coupled to the frame 121, and a first feed roller 143 and a second feed roller 144 rotatably coupled to the frame 121 for separating a first top sheet and a second top sheet from the first and second stacks 137 and 138 of sheets, respectively, one at a time, and feeding the first top sheet and the second top sheet, respectively toward the printer. The initial moving directions of the first top sheet and the second top sheet, respectively, define a first sheet moving direction and a second sheet moving direction, respectively. The sheet feeder 120 further still includes a first pair of springs 145 and a second pair of springs 146 for resiliently biasing the first and second trays 135 and 136, respectively, whereby the first and second trays 135 and 136 urge the first top sheet and the second top second sheet, respectively, of the first and second stacks 137 and 138 of sheets, respectively, against the first and second feed rollers 143 and 144, respectively. The frame 121 of the sheet feeder 120 also provides a third bin **145*a* which is disposed generally under the first and second bins 125 and 126 for accommodating a continuous sheet 148 wherein the first and second bins 125 and 126 provide a passway 147 therebetween so that the continuous sheet 148 may be directed upwardly through the passway 147, between the first and second sheet guides 141 and 142, through the pair of guide rollers 139** and fed to the printer.

Figure 6:
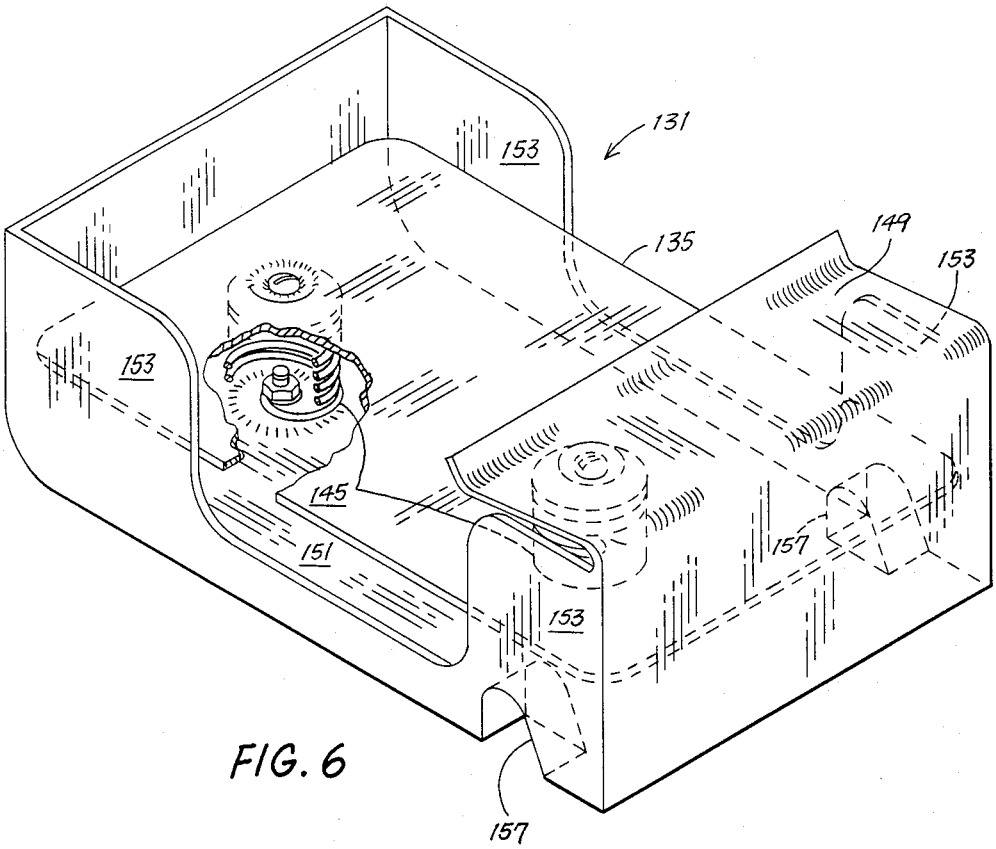
FIG. 6 is a perspective drawing of a cassette of the sheet feeder of FIG. 5 in partial cross-section.

The first cassette 131 is depicted in detail in FIG. 6. Referring to FIG. 6 in conjunction with FIG. 5 the first cassette 131 of the sheet feeder 120 has a first sheet holding flap 149, which is resilient, for holding the first stack 137 of sheets thereunder. The first cassette 131 has a first bottom 151 and a first set of sidewalls 153 for containing the first tray 135 and for holding the first stack 137 of sheets in place. The first bottom 151 and the first tray 135 are connected by a first pair of springs 145 whereby the first tray 135 urges the first stack 137 of sheets against the first feed roller 143. The first cassette 131 has a first pair of indentations 157 in its first bottom 151 and a first set of sidewalls 153 and may be securely, but removably enaged with the first pair of projections 129 on the first base plate 127.

Referring to FIG. 5 again the second cassette 132, depicted in FIG. 5, is identical to the first cassette 131 except that the second cassette 132 is longer than the first cassette 131 in the direction of the first sheet moving direction and the second sheet moving direction, respectively, thereby its second tray and second set of sidewalls are accordingly longer and each of its second pair of springs are disposed at a longer distance apart from the other. The second cassette 132 has a second pair of indentations 158 at suitable locations so that the second pair of indentations 158 may also be duly engaged with the first projections 129 when the second cassette 132 is disposed on the first base plate 127. Accordingly the second cassette 132 may be exchangeable with a cassette which is identical to the first cassette 131 and the first cassette 131 may be exchangeable with a cassette which is identical to the second cassette 132. The first and second bins 125 and 126 are identical to each other and are symmetrically disposed about a vertical plane passing between the pair of guide rollers 139.

Referring to FIG. 5 in conjunction with FIG. 1 and FIG. 4 the sheet feeder 120 may be controlled and operated in exactly the same manner as the sheet feeder 20 is controlled and operated.

Referring to both FIG. 1 and FIG. 5 swivel casters 200 are fixedly coupled to the frames 21 and 121 thereby the user may easily move the sheet feeders 20 and 120 for, as an example, loading the first and second stacks 31 and 32 of sheets and the first and second stacks 137 and 138 of sheets, respectively.

From the foregoing it can be seen that a sheet feeder for use in combination with a printer has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A sheet feeder for use in combination with a printer which has a sheet inlet, said sheet feeder comprising:

a. a frame which is substantially symmetrical about a bisecting vertical plane and which is divided into a first portion of said frame and a second portion of said frame, which are substantially identical to each other, by said bisecting vertical plane, said frame having a top which is in a first horizontal plane on which said printer is disposed;

b. a first tray which is disposed in said first portion of said frame and parallel to a first plane, which is slanted with respect to said first horizontal plane, and which is movably coupled to said frame, said first tray having a first leading edge adjacent, but not contiguous, to said vertical bisecting plane wherein a first stack of sheets, face up, can be disposed parallel to said first plane on said first tray;

c. first sheet feeding means coupled to said frame for separating a first top sheet from said first stack of sheets and feeding said first top sheet toward said printer wherein the initial moving direction of said first top sheet defines a first sheet moving direction;

d. a second tray which is disposed in said second portion of said frame and parallel to a second plane, which is slanted with respect to said first horizontal plane, and which is movably coupled to said frame, said second tray having a second leading edge adjacent, but not contiguous, to said vertical bisecting plane wherein a second stack of sheets, face down, can be disposed parallel to said second plane on said second tray and wherein said first and second trays are opposingly disposed to each other so that, when said first leading edge of said first tray and said second leading edge of said second tray are disposed in the same plane, which is parallel to said first horizontal plane and orthogonal to said bisecting vertical plane, said first and second trays form a generally inverted V-shape;

e. second sheet feeding means coupled to said frame for separating a second top sheet from said second stack of sheets and feeding said second top sheet toward said printer wherein the initial moving direction of said second top sheet defines a second sheet moving direction; and f. a sheet outlet which is adjacent and contiguous to said top of said frame and which can be aligned with said sheet inlet of said printer whereby a sheet from said sheet feeder can be fed to said printer.

2. A sheet feeder according to claim 1 wherein said sheet feeder also comprises:

a. first supporting means coupled to said frame for supporting said first tray;

b. first holding means coupled to said frame for holding said first stack of sheets in place;

c. first resiliently biasing means coupled to said frame for resiliently biasing said first tray whereby said first tray urges said first stack of sheets against said first sheet feeding means;

d. second supporting means coupled to said frame for supporting said second tray;

e. second holding means coupled to said frame for holding said second stack of sheets in place; and f. second resiliently biasing means coupled to said frame for resiliently biasing said second tray whereby said second tray urges said second stack of sheets against said second sheet feeding means.

3. A sheet feeder according to claim 2 wherein said first and second sheet feeding means, respectively, comprise:

a. a first feed roller rotatably coupled to said frame for separating said first top sheet from said first stack of sheets and feeding said first top sheet toward said printer;

b. first driving means coupled to said frame for driving said first feed roller;

c. a second feed roller rotatably coupled to said frame for separating said second top sheet from said second stack of sheets and feeding said second top sheet toward said printer; and d. second driving means coupled to said frame for driving said second feed roller.

4. A sheet feeder according to claim 1 or claim 2 or claim 3 wherein said sheet feeder further comprises a first bin in which said first tray is disposed and a second bin in which said second tray is disposed.

5. A sheet feeder according to claim 4 wherein said sheet feeder still further comprises a third bin which is disposed generally under said first and second bins for accommodating a continuous sheet wherein said first bin and said second bin provide a passway therebetween so that said continuous sheet can be directed upwardly through said passway and fed to said printer through said sheet outlet of said frame.

6. A sheet feeder according to claim 3 wherein said first driving means is a first motor and said second driving means is a second motor.

7. A sheet feeder according to claim 3 wherein said first and second holding means, respectively, comprise:

a. a first sheet holding plate which is movably coupled to said first tray, the position of which is adjustable in a direction which is parallel to said first sheet moving direction and which upholds said first stack of sheets on the trailing edge-side of said first stack of sheets thereby preventing said first stack of sheets from slipping down;

b. a first pair of vertical side plates which position said first stack of sheets therebetween and which are movably coupled to said frame whereby said first pair of vertical side plates are adjustable horizontally and orthogonally to said first sheet moving direction;

c. a second sheet holding plate which is movably coupled to said second tray, the position of which is adjustable in a direction which is parallel to said second sheet moving direction and which upholds said second stack of sheets on the trailing edge-side of said second stack of sheets thereby preventing said second stack of sheets from slipping down; and d. a second pair of vertical side plates which position said second stack of sheets therebetween and which are movably coupled to said frame whereby said second pair of vertical side plates are adjustable horizontally and orthogonally to said second sheet moving direction.

8. A sheet feeder according to claim 1 wherein said sheet feeder also comprises:

a. a first cassette removably coupled to said frame, said first cassette, containing said first tray, having sidewalls for holding said first stack of sheets in place;

b. first resiliently biasing means for resiliently biasing said first tray coupled to said first cassette whereby said first tray urges said first stack of sheets against said first sheet feeding means;

c. a second cassette removably coupled to said frame, said second cassette, containing said second tray, having sidewalls for holding said second stack of sheets in place; and d. second resiliently biasing means for resiliently biasing said second tray coupled to said second cassette whereby said second tray urges said second stack of sheets against said second sheet feeding means.

9. A sheet feeder according to claim 8 wherein said sheet feeder further comprises a bin which is disposed generally under said first and second cassettes for accommodating a continuous sheet wherein said first cassette and said second cassette provide a passway therebetween so that said continuous sheet can be directed upwardly through said passway and fed to said printer through said sheet outlet of said frame.

* * * * *